United States Patent [19]

Bernath

[11] Patent Number: 4,838,975

[45] Date of Patent: Jun. 13, 1989

[54] ARRANGEMENT FOR PRESSURE ADJUSTMENT IN A VENEER ASSEMBLYING MACHINE

[75] Inventor: Oskar Bernath, Umiken, Switzerland

[73] Assignee: Georg Fischer AG Brugg

[21] Appl. No.: 196,136

[22] Filed: May 19, 1988

[30] Foreign Application Priority Data

May 19, 1987 [CH] Switzerland ..... 01921/87

[51] Int. Cl.[4] ..... B27D 3/04

[52] U.S. Cl. ..... 156/564; 156/558; 156/583.1

[58] Field of Search ..... 156/358, 558, 559, 583.1, 156/360, 364

[56] References Cited

U.S. PATENT DOCUMENTS

| | | | |
|---|---|---|---|
| 3,963,555 | 6/1976 | Zweig | 156/558 X |
| 4,212,699 | 7/1980 | Braunschweiler | 156/558 |
| 4,243,465 | 1/1981 | Gozzi | 156/558 X |
| 4,615,759 | 10/1986 | Ofa | 156/558 |

FOREIGN PATENT DOCUMENTS 425182 10/1985 Switzerland .

*Primary Examiner*—David Simmons

*Attorney, Agent, or Firm*—Toren, McGeady & Associates

[57] ABSTRACT

An arrangement for pressure adjustment in a veneer assembling machine has at least two conveying units which include alternatingly raisable and lowerable heating and conveying rails which are arranged parallel next to each other on transverse support members. Each rail has on the input side and the output side of the veneer assembling machine a cylinder each to which a pressure medium can be admitted. At least to the pressure cylinders at the input side arranged transversely of the travel direction of the veneer differently adjustable pressures can be admitted. The pressure cylinders are differently controllable through a valve control in dependence upon a workpiece edge scanning device.

9 Claims, 2 Drawing Sheets

60a
52
18
15
6, 3a
25
18C
9
18A
4, 2a
24
18 M
13
51
18 B
18D
50c
50 b
50a
10
11
16
17
60 b
32
31
34
33
30
36
35
47a
41
40
46a
45a
44 b
42b
43b
43a
42a
39
45 b
44a
38
48
46
47
48
37
49

ARRANGEMENT FOR PRESSURE ADJUSTMENT IN A VENEER ASSEMBLYING MACHINE

BACKGROUND OF THE INVENTION

1. Field of the Invention

The present invention relates to an arrangement for pressure adjustment in a veneer assembling machine. The veneer assembling machine has at least two conveying units which include alternatingly raisable and lowerable heating and conveying rails which are arranged parallel next to each other on transverse support members. Each rail has on the input side and the output side of the veneer assembling machine a cylinder each to which a pressure medium can be admitted.

2. Description of the Prior Art

An arrangement of the above-described type has become known from Swiss Pat. No. 425,182. In this arrangement, the same adjustable pressure of a medium can be admitted to all pressure cylinders.

However, it has been found that when veneers are assembled and glued together into a material web in the above-described arrangement, the veneers do not assume a straight-line position after a period of time. Rather, the veneers deviate obliquely or in an arc-shape laterally to one and/or the other side. The reasons therefore may be different frictional conditions existing at the heating and conveying rails which may be due to dirt which accumulates over the time.

Such an oblique arrangement of the veneer pieces in feeding direction may particularly occur when the veneer pieces are not exactly parallel. This may lead to problems in subsequently arranged treatment units and/or may lead to obliquely cut veneer sheets.

When the veneer pieces are fed into the machine manually, this oblique positioning of the veneer pieces can be compensated by intermediately placing veneer pieces which are not entirely parallel. Of course, this is not possible in an automatic machine with feeding unit.

It is, therefore, the object of the present invention to provide an arrangement of the above-described type in which a rectilinear passage of the veneer pieces through the machine and a straight veneer web are possible even in an automatic operation.

SUMMARY OF THE INVENTION

In accoraance with the present invention, at least to the pressure cylinders at the input side arranged transversely of the travel direction of the veneer differently adjustable pressures can be admitted. The pressure cylinders are differently controllable through a valve control in dependence upon a workpiece edge scanning device.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
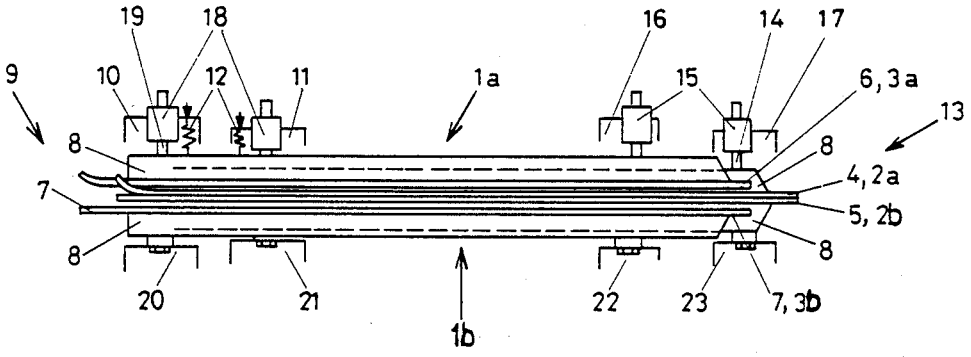
FIG. 1 is a side view of the arrangement according to the present invention.
Figure 2:
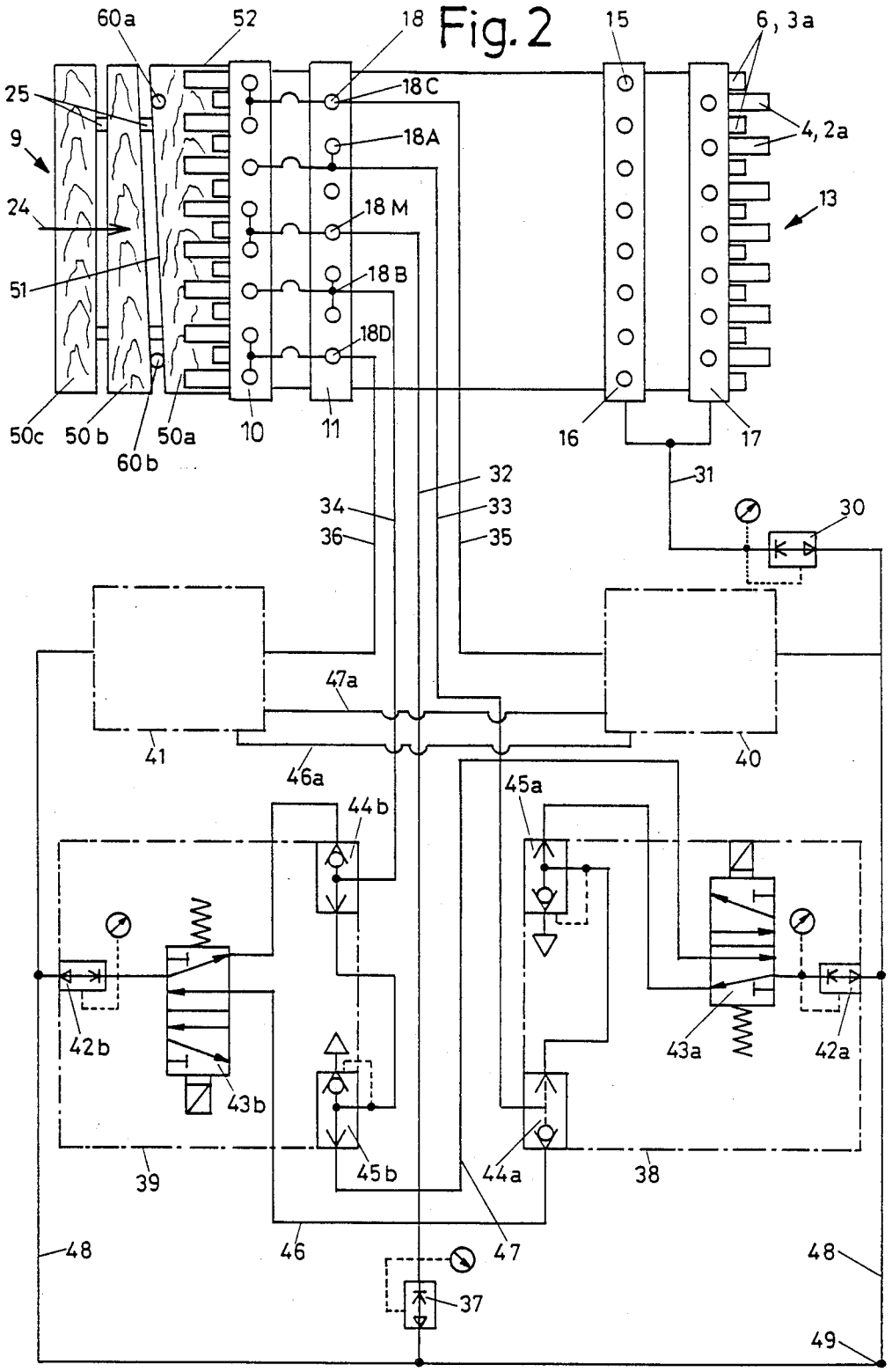
FIG. 2 is a top view of the arrangement of FIG. 1, including a switching diagram of the valve control for the pressure adjustment.

FIGS. 1 and 2 of the drawing show a veneer assembling machine with an upper rail bed 1*a* and a lower rail bed 1*b* with two groups of rails each 2*a*, 3*a* and 2*b*, 3*b*, respectively. The veneer assembling machine is used for assembling workpieces 50, such as, veneer pieces, to form a veneer web 52.

One of the rail groups 2*a*, 2*b* includes upper and lower conveying and heating rails 4, 5 and the other rail group 3*a*, 3*b* includes upper and lower conveying and heating rails 6, 7. The upper conveying and heating rails 4, 6 are reinforced by support rails 8 and are resiliently suspended on the input side 9 on a vertically adjustable transverse support member 10, 11 each by means of tensions springs 12. By contrast, the conveying and heating rails 4, 6 are suspended on the output side 13 without springs on piston rods 14 of the pressure pistons of pressure cylinders 15 which are also connected to vertically adjustable transverse support members 16, 17. In addition, pressure cylinders 18 are fastened on the input side 9 on the transverse support members 10 and 11. The pressure pistons of pressure cylinders 18 are in operative connection through piston rods 19 with the conveying and heating rails 4, 6.

The lower conveying and heating rails 5, 7 which are also provided with support rails 8 are connected to lower transverse support members 20, 21 and 22, 23 which are vertically adjustable. The conveying and heating rails 4 to 7 are heated by means of a heatable medium. This manner of heating is not illustrated.

The veneer pieces 15 or veneer web 52 are moved forwardly by means of an alternating stepping motion of the two lower and upper rail groups 2*a*, 2*b* and 3*a*, 3*b*. An appropriate feeding drive, not shown, can be used for this forward movement.

As can be seen in FIG. 2, two light barriers 60*a* and 60*b* are arranged on the input side 9. The light barrier 60*a* and 60*b* scan the edge 51 extending transversely of the travel direction 24 of the last veneer piece 50*a* located between the rail beds 1*a*, 1*b*. The next following veneer pieces 50*b*, 50*c* are advanced by means of a known feeding device which includes spacer cams 25.

A pressure medium, preferably compressed air, can be admitted to the pressure cylinders 15 and 18. A constant air pressure adjustable by means of a pressure adjusting valve 30 is admitted through a line 31 to the pressure cylinder 15 arranged on the output side 13 on the transverse support members 16 and 17.

The pressure cylinders 18 arranged on the input side 9 on the two transverse support members 10 and 11 are connected in groups of three to a compressed air line 32, 33, 34, 35, 36 each.

A pressure cylinder group 18M is arranged in the middle as seen transversely of the travel direction. To this pressure cylinder group 18M, an adjustable pressure can be admitted constantly through the line 32 and a pressure regulating valve 37.

The remaining pressure cylinder groups 18A, 18B, 18C, 18D arranged to the side of the group 18M are in operative connection through lines 33, 34, 35, 36 with valve control groups 38, 39, 40, 41. Each of the valve control groups 38, 39, 40, 41 includes a pressure regulating valve 42, a 5/2-way solenoid valve 43, an OR-valve 44 and a quick-venting valve 45. The OR-valve 44*a* of the valve control groups 38 is additionally connected through a line 46 to the 5/2-way solenoid valve 43*b* of the valve control group 39. The 5/2-way solenoid valve 43*a* of the valve control group 38 is operatively connected through a line 47 to the quick-venting valve 45*b* of the valve control group 39.

The same type of operative connection exists between the two valve control groups 40 and 41 through lines 46*a*, 46*b*. All pressure regulating valves 30, 37 and 42 are connected through a distributor line 48 to a compressed air source 49.

Figure 3:
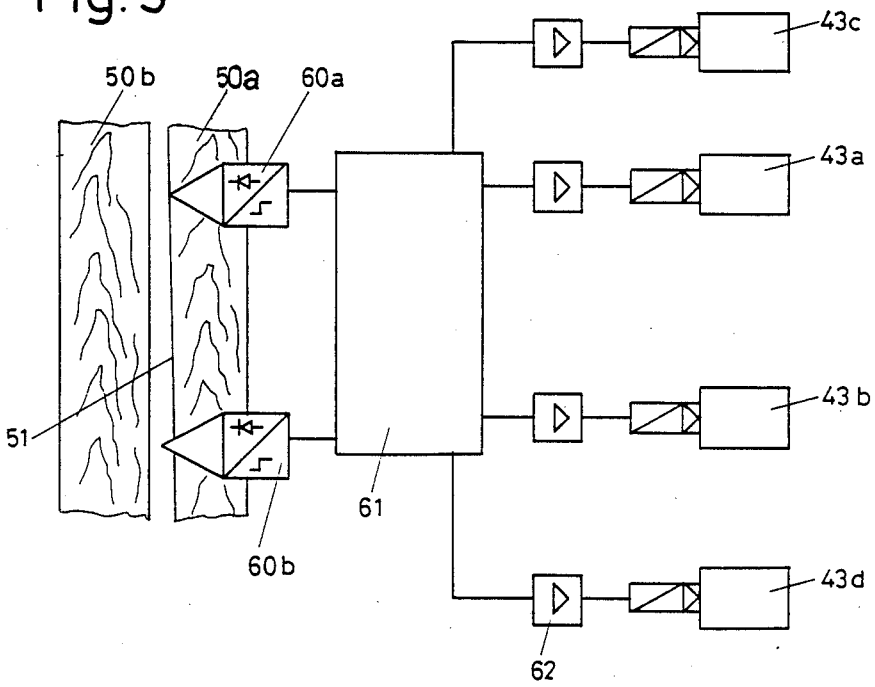
FIG. 3 is a block diagram of the control.

As illustrated in FIG. 3, the light barriers 60*a*, 60*b* are connected through a logic control 61 and amplifiers 62 to the 5/2-way solenoid valves 43*a*, 43*b*, 43*c*, 43*d* of the valve control groups 38 to 41.

The correction of obliquely introduced veneer pieces 50 is carried out as follows.

If an oblique position of the edge 51 of the veneer piece 50*a* is detected by the light barriers 60*a* and 60*b*, appropriate electrical signals of the light barriers are supplied to the logic control 61. The signals are processed in the logic control 61 and are amplified and supplied to the corresponding 5/2-way solenoid valves.

Prior to operation, the pressures at the pressure regulating valves are adjusted in such a way that a medium pressure is effective in the middle pressure cylinder group 18A and step-by-step lower pressure is effective to one side and step-by-step higher pressure is effective on the other side of group 18M in the pressure cylinder groups 18A, 18B, 18C, 18D. A switch from one side to the other is effected by means of the valve control groups depending upon the direction of the oblique position of edge 51. For example, in the case of a certain type of veneer, a medium pressure of 3 bar is adjusted in pressure regulating valve 37, a pressure of 2.5 bar is adjusted in the pressure regulating valve 42*a* of the valve control group 38, a pressure of 2 bar is adjusted in the pressure regulating valve of the valve control group 40, a pressure of 3.5 bar is adjusted in the pressure regulating valve 42*b* of the valve control group 39 and a pressure of 4 bar is adjusted in the valve control group 41.

As illustrated in FIGS. 2 and 3 as an example, edge 51 trails in travel direction 24 on the side of the light barrier 60*a* relative to the side of the light barrier 60*b*. To align edge 51 to be perpendicular to the travel direction 24, the pressure exerted by the pressure cylinders 18 on the side of the light barrier 60*a* must be increased relative to the medium pressure and the pressure must be reduced on the other side. Through the scanning by means of the light barriers 60*a*, 60*b* and the logic control 61, the 5/2-way magnetic valves 43*a*, 43*b*, 43*c*, 43*d* are switched in such a way that the appropriately adjusted pressure corresponding to the solenoid valves is supplied as required to the pressure cylinder groups.

The higher pressure (for example 3.5 bar) adjusted in pressure regulating valve 42*b* is conducted through line 46 to OR-valve 44*a* and from there through line 33 to pressure cylinder group 18A. The lower pressure (for example, 2.5 bar) adjusted in the pressure regulating valve 42*a* is conducted through line 47 to venting valve 45*b* and then to OR-valve 44*b* and through lines 34 to pressure cylinder group 18B.

The same type of operative connection exists between the two valve control groups 40 and 41 through lines 46*a* and 47*a*, so that the pressure cylinder group 18C is supplied with the higher pressure (for example, 4 bar) adjusted in the valve control group 41 and the pressure cylinder group 18D is supplied with the lower pressure (for example, 2 bar) adjusted in the valve control group 40.

If edge 51 of veneer piece 50*a* is oblique towards the other side, the light barriers 60*a*, 60*b* and the logic control 61 effect a switching of the 5/2-way solenoid valve, so that the pressure cylinder groups 18A and 18C are supplied through lines 33 and 35 with the lower pressure adjusted in the valve control groups 38 and 40. The flow of the compressed air can be seen from the diagram of FIG. 2. The pressure cylinder groups 18B, 18D are supplied through lines 34 and 36 with the higher pressure adjusted in the valve groups 39, 41.

The pressure in the middle pressure cylinder group 18M does not change during this regulating procedure. In the case of an even number of pressure cylinder groups, it is advantageous to supply all the pressure cylinder groups with different pressures by means of a corresponding valve control group.

If the veneer assembling machine has a great width, it is possible to connect a greater number of pressure cylinder groups with the appropriate number of valve control groups, wherein each pressure cylinder group may have one or more, preferably three, pressure cylinders.

While a specific embodiment of the invention has been shown and described in detail to illustrate the application of the inventive principles, it will be understood that the invention may be embodied otherwise without departing from such principles.

I claim:

1. An arrangement for pressure adjustment in a veneer assembling machine having an input side and an output side, the veneer assembling machine comprising at least two conveying units including alternatingly raisable and lowerable heating and conveying rails, the heating and conveying rails being arranged parallel next to each other on transverse support members, each rail having on the input side and the output side of the veneer assembling machine a pressure cylinder each to which a pressure medium can be admitted for applying pressure to the veneer, the pressure cylinders at the input side being arranged in a row extending transversely of the travel direction of the veneer, means for admitting differently adjustable pressures to at least the pressure cylinders at the input side, and a workpiece edge scanning device, the pressure cylinders being differently controllable through a valve control operated in dependence upon the workpiece edge scanning device.

2. The arrangement according to claim 1, wherein to a group each of adjacent pressure cylinders the same pressure is admitted.

3. The arrangement according to claim 2, wherein to a pressure cylinder group in the middle as seen in transverse direction always the same adjustable medium pressure is admitted, and wherein to the adjacent groups of pressure cylinders step by step a higher pressure is admitted to one side and a lower pressure is admitted step by step to the other side, and valve control groups are for switching from one side to the other side by means of the scanning device.

4. The arrangement according to claim 3, wherein the workpiece edge scanning device includes at least two light barriers arranged at the input side, the light barriers determining the position of the workpiece edge.

5. The arrangement according to claim 4, wherein each valve control group includes a pressure reducing valve, a 5/2-way solenoid valve connected to the pressure reducing valve, an OR-valve controlled by the pressure medium pressure and a quick-venting valve connected to the OR-valve.

6. The arrangement according to claim 5, wherein a valve control group for the pressure cylinder group on one side is connected for operation with the valve control group for the corresponding pressure cylinder group on the other side.

7. The arrangement according to claim 6, wherein the operative connection is effected by means of a line leading from the OR-valve of one valve control group to the 5/2-way solenoid valve of the corresponding other valve control group and by a line of the 5/2-way solenoid valve leading to the quick-venting valve.

8. The arrangement according to claim 5, wherein the light barriers are connected operatively through a logic control to the 5/2-way solenoid valves.

9. The arrangement according to claim 1, wherein the pressure medium is compressed air.

* * * * *